United States Patent [19]

Graff et al.

[11] 4,137,347

[45] Jan. 30, 1979

[54] METALLIC COATING METHOD

[75] Inventors: Hart F. Graff, Middletown; John B. Kohler, Greentown; Noel W. Parks, Middletown; Marvin B. Pierson, Middletown; Paul E. Schnedler, Middletown, all of Ohio; Richard E. Strait, Ashland, Ky.

[73] Assignee: Armco Steel Corporation, Middletown, Ohio

[21] Appl. No.: 830,457

[22] Filed: Sep. 6, 1977

Related U.S. Application Data

[63] Continuation of Ser. No. 841,936, Jul. 15, 1969, abandoned.

[51] Int. Cl.[2] ..... B05C 11/10

[52] U.S. Cl. ..... 427/349; 118/63; 427/433; 427/436; 427/434 R

[58] Field of Search ..... 118/63; 15/306.1; 239/564, 590, 592, 597; 427/349, 433, 434, 436

[56] References Cited

U.S. PATENT DOCUMENTS

| | | | |
|---|---|---|---|
| 3,314,163 | 4/1967 | Kohler | 118/63 X |
| 3,526,204 | 9/1967 | Schnedler | 118/8 |

*Primary Examiner*—William A. Powell

*Attorney, Agent, or Firm*—Melville, Strasser, Foster & Hoffman

[57] ABSTRACT

A method for finishing molten metallic coatings applied to iron and steel strip by the use of an elongate, laminar flow fluid jet, which jet is used to control thickness and quality of the finished coating.

The narrow dimension of the fluid jet is contoured across the strip width to produce the desired coating weight at all parts of the strip and to produce a coated strip edge free from excessively heavy coatings and/or oxide "berries."

3 Claims, 5 Drawing Figures

METALLIC COATING METHOD

CROSS REFERENCE TO RELATED APPLICATION

This application is a continuation of application Ser. No. 841,936, filed July 15, 1969, in the name of the inventors and entitled METALLIC COATING METHOD, now abandoned.

BACKGROUND OF THE INVENTION

It is well recognized in the art that a continuous metallic coating operation, considered generally, includes the steps of first preparing the surface of the strip to be coated to receive the molten coating metal, thereafter passing the base metal into a bath of molten coating metal, and finally finishing the applied coating. As used in this specification, the term "finishing" includes the steps of controlling, smoothing and solidifying the coating metal.

According to conventional practice, the controlling and smoothing of the molten coating metal is accomplished by the utilization of exit rolls which contact the molten coating metal on the surface of the strip as it emerges from the molten coating bath. The solidification of the coating metal which remains on the strip is accomplished by various expedients including a water quench, or the like.

It is recognized in the art that the use of exit rolls as described above does not give highly precise control over the thickness of the coating. In fact, maintaining consistency of coating thickness from edge to edge of a given strip is accomplished largely by manually changing the contour of the exit rolls during operation. This of course is an extremely difficult operation and requires highly skilled operators. In addition, this continual changing of contours of the exit rolls gives rise to a rapid rate of deterioration, requiring replacement of exit rolls on a relatively frequent basis.

It is also known that exit rolls will frequently leave a characteristic "tiger stripe" marking on the surface of the coating due to grooves in the rolls, or to the presence of dross and oxide picked up from the bath and adhering to the rolls.

Commercial experience with metallic coatings generally has established that the use of a mechanical finishing arrangement including, for example, exit rolls imposes a maximum speed limitation on the entire process. That is, it is impossible when using exit rolls to operate a coating line beyond a certain strip speed and still obtain a satisfactory surface finish.

Experience has also shown that the use of exit rolls creates additional problems in specific situations. That is, for example, in coating steel with terne or lead, it has been necessary to include up to 17% tin in the coating bath in order to properly wet the exit rolls. Since tin is not particularly desirable in the coating bath, and is a relatively expensive material, it would be highly desirable to develop a system which could successfully apply a low-tin terne coating.

SUMMARY OF THE INVENTION

Briefly considered, this invention is concerned primarily with the finishing of a molten metallic coating. Assuming that the surface of the strip to be coated has been properly prepared, the strip is passed into a bath of molten coating metal and withdrawn from the bath in a generally vertical path of travel. As the strip emerges from the bath of molten coating metal, it will withdraw or pull with it a portion of the molten coating metal forming a concave meniscus. According to this invention, the non-uniform surface layer of coating metal on the strip is cleanly sheared by a laminar flow fluid jet so that the outer portion of the coating metal flows back to the bath, while a desired quantity of coating metal adheres or remains on the strip. The quantity of molten metal adhering to the strip (the thickness of the finished coating) is controlled according to this invention by varying as set forth in more detail hereinafter the velocity of the fluid jet, the angle of impingement of the jet on the coated strip, the height of the point of impingement, and the shape of the nozzle opening producing the jet.

The shape or contour of the nozzle opening will contour the narrow dimension of the fluid jet and hence permit variation of the jet wiping action across the strip width. Thus, it is possible to produce optimum coating weight distribution across the strip width, including the elimination of heavy coating concentrations and oxide berries at the strip edges.

Recalling the earlier comments with respect to the state of the prior art, it is a primary object of this invention to provide a method of finishing a metallic coating which will permit significantly higher operating speeds.

Another object of this invention is the provision of a method for finishing a metallic coating giving far greater control over the thickness of the finished coating.

Another object of the invention is to provide a method whereby different coating thickness can be applied to the two sides of a given strip.

A further object of the invention is to provide a coating method which requires a minimum of maintenance over substantial operating periods.

Still a further object of the invention is to provide a method wherein coating thickness across the faces of the strip may be controlled as desired.

Still another, and specific object of the invention is to provide a method which will permit application of a low-tin content terne coating.

DESCRIPTION OF THE PREFERRED EMBODIMENT

Figure 1:
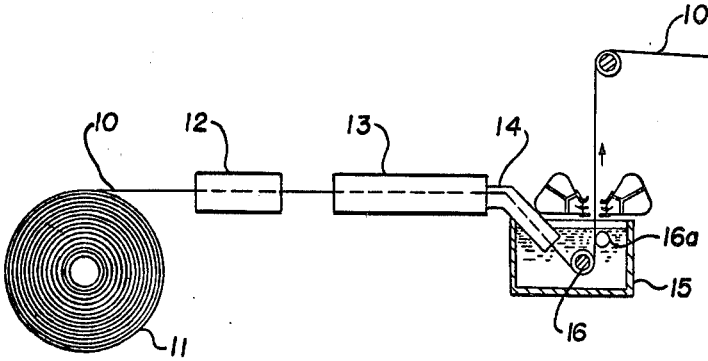
FIG. 1 is a schematic drawing of a coating operation according to this invention.

Turning now to FIG. 1, the process of this invention has been schematically illustrated. A strip 10 of the ferrous base metal to be coated is uncoiled from the coil 11 and passed through the cleaning unit 12. The cleaning unit 12 can be either of the well known wet chemical cleaning type or of the heat type wherein the strip is heated in an oxidizing atmosphere so as to form a thin homogeneous oxide coating thereon.

In either case, the strip is then passed into a continuous annealing and reducing furnace 13. In this reducing furnace 13 any oxides formed on the surface of the base metal by the cleaning unit 12 are reduced to a thin coating of nascent iron.

According to the preferred practice of the invention, the strip 10 will be cooled to approximately the temperature of the molten bath in a cooling zone of the furnace, and then from the furnace into the snout 14 which is provided with a suitable neutral or reducing atmosphere. The end of the snout 14 is submerged in the molten metal in the bath 15. The strip 10 emerges from the snout 14, passes around the sinker roll 16, past the stabilizer roll 16*a*, and emerges from the molten bath in a substantially vertical path of travel.

The oxidation-reduction treatment generally set forth above comprises the well-known Sendzimir process, first taught in U.S. Pat. No. 2,110,893, and now in wide spread commercial use. All aspects and ramifications of the steps set forth above are explained in more detail in this patent and its related cases. It should be understood that this method of preparation is exemplary only and is not necessary for the practice of the invention. Other methods of strip preparation such as the pickle and flux process may be used.

As the strip emerges from the coating bath, it will withdraw with it a quantity of molten coating metal. This is known as the "pumping action" of the strip, and can be controlled by varying either the degree of smoothness of the strip surface, or by varying the operating speed of the strip. That is, a roughened strip surface will pump a greater quantity of molten coating metal than a smooth surface. Similarly, a high strip speed will pump more molten metal than a slower coating speed.

Figure 2:
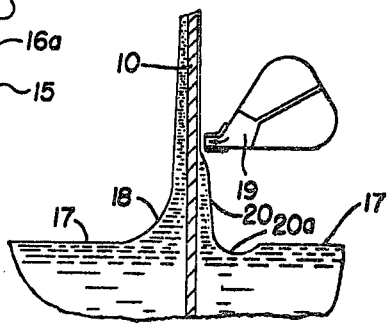
FIG. 2 is a schematic diagram showing in the left-hand portion the meniscus formed by the molten coating metal withdrawn from the bath by the moving strip and in the right-hand portion the action of the laminar flow fluid jet in finishing the molten coating.

Referring to FIG. 2, the strip being coated is again indicated at 10. The normal level of coating metal in the bath is indicated at 17. Referring to the left-hand portion of the strip 10, it will be observed that the moving strip withdraws a quantity of molten coating metal with it forming a meniscus 18 extending above the normal level of the bath 17.

According to this invention, an elongate, substantially laminar flow fluid jet indicated by the arrow 19 on the right-hand side of the strip will be directed at the still molten coating metal at a point where the thickness of coating metal is greater than the desired final coating thickness. The action of this fluid jet effects a clean shearing of the molten coating metal so that the outer portion thereof indicated at the right-hand portion of FIG. 2 at 20 flows backwards to the bath, while a desired quantity of the coating metal adheres to the strip. The vertical deflection of the fluid jet will effect a smoothing action on the coating metal above the point of impingement and may even cause a slight but noticeable depression in the bath surface as at 20*a*.

The finished, still molten coating metal remaining on the strip is then solidified in any conventional manner (not shown) and the coated strip is coiled at 21 for shipment or further processing.

As explained earlier in this application, it is important that the fluid jet directed at the coating of molten metal cleanly shear the coating while producing a smoothing of the surface of that portion of the coating metal which remains on the ferrous base strip. This is accomplished, according to one aspect of the instant invention, by the utilization of an elongate, substantially laminar flowing jet of gaseous fluid. Pressure variation or turbulence in the fluid jet will produce disturbances on the surface of the coated strip. Turbulence in or along the upper and lower boundaries of the jet will creat turbulence in the sheared molten coating metal, producing distortions and residual pattern in the coating metal remaining on the strip.

In addition, it is well known in the art that the surface of the coating metal in the bath (especially in the case of aluminum or zinc) will be covered with oxide, dross, and the like, and that these oxides and dross will be drawn upward by the pumping action of the strip along the meniscus. If the shearing action is not sharp and clean, portions of oxide and dross will be entrained in the final metallic coating.

Therefore, to maintain finished coating uniformity, the jet flow should be laminar, and characterized by a sharp velocity gradient across its narrow dimension. That is, the boundaries of the jet in its narrow dimension, flow at almost the same velocity as the internal laminae of the fluid jet, while there is a minimum entrainment of the surrounding atmosphere because of the general absence of turbulent vortices.

Preferably, the jet should be operated at a pressure low enough that the pressure drop between the plenum and external atmosphere does not cause turbulence. Theoretical investigations indicate that the plenum pressure should be less than about 50% greater than the pressure outside the nozzle (measured on an absolute basis) in order to insure that complete expansion of the fluid takes place within the confines of the nozzle. Such a fluid jet is operating at sub-sonic velocity.

Preferably, the nozzle should be of the convergent type so constructed that the maximum velocity of the effluent is reached at the point of exit from the nozzle rather than within the nozzle or outside the nozzle. Under this condition, minimum turbulence is generated.

The thickness of the coating metal remaining on the strip after passing the fluid jet (and hence the finished coating weight) will be controlled by the relationship of two general factors. These are first of all, the quantity of molten coating metal withdrawn from the bath by the moving strip, and secondly, the quantity of this molten metal sheared by the jet and returned to the bath.

As generally indicated earlier, the quantity of metal withdrawn from the bath by the moving strip is a function of strip speed, the surface condition of the strip, the viscosity of the coating metal, and the density of the coating metal. These factors will combine to determine the shape of the meniscus 18 schematically illustrated in FIG. 2.

The quantity of still molten coating metal sheared off by the fluid jet and returned to the bath will depend on the following factors: the velocity of the jet, the sharpness of the velocity gradient across the narrow dimension of the jet, the size of the narrow dimension of the jet, the distance from the nozzle to the strip, the height of impingement of the jet above the bath, and the angle of impingement.

The nature of these last mentioned factors may be briefly set forth as follows. The velocity of the jet (assuming a sub-sonic velocity) is proportional to the square root of the pressure drop. The velocity gradient across the narrow dimension of the jet will be imparted initially by a correct nozzle design; thereafter the sharpness of the velocity gradient will decrease as a function of distance from the nozzle. The narrow dimension of the jet will of course be determined by nozzle opening; the wiping effect of the jet is proportional to nozzle opening. Thus, an increase in the narrow dimension of the fluid jet will produce a greater wiping or shearing action. The shearing or wiping action of the fluid jet will also vary roughly with the square of the nozzle to strip distance. The height and angle of impingement of the fluid jet determine the point at which the meniscus of coating metal is sheared. Thus, these factors will affect both the quantity of metal remaining on the strip as well as the quantity of metal returned to the bath.

A very important aspect of this invention is the contouring of the narrow dimension of the fluid jet. As will be explained now, this contouring will produce optimum coating weight distribution across the strip width, and eliminates the problem of edge berries and heavy metal at the strip edge.

It is widely recognized in the industry that while a uniform distribution of coating material across the base metal width is to be desired from a theoretical standpoint, practical considerations dictate otherwise. That is, if the coating weight at one or both edges of the strip is greater than the weight at the center of the strip, coiling difficulties are encountered including spooling and/or severe damage to the edges of the strip. Therefore, as a practical matter, optimum coating weight distribution across the strip width requires a very slightly convex cross section of coating material. That is, in the case of a one ounce per foot nominal zinc coating, it would be desired to have 1.00 ounces per square foot of coating material at the center of the strip, and to have on the order of 0.94 ounces per square foot of coating material near the strip edges.

Figure 3:
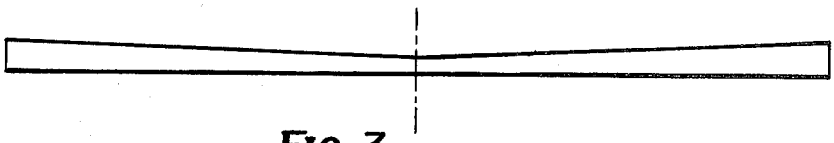
FIG. 3 is a schematic illustration of the preferred contour for the jet nozzle opening.

To achieve this optimum coating weight distribution, it is preferred that the narrow dimension of the fluid jet nozzle be contoured as schematically illustrated in FIG. 3. That is, the narrow dimension of the nozzle opening progressively increases from the center to the edge of the nozzle.

Since the pressure of the fluid within the nozzle is constant, increasing the nozzle opening increases the fluid jet flow rate and increases average velocity of the fluid jet stream. Thus, the wiping force of the jet increases progressively from the center of the nozzle to the ends (or from the center of the strip toward the edges). Thus, the progressive increase in the narrow dimension of the fluid jet from the center of the strip toward the edges has been found to produce the optimum coating weight distribution set forth above.

Oxide "berries" are caused by particles of oxide scum on the bath surface adhering to the strip, particularly at the edges.

"Heavy metal concentration" is a condition generally occurring within about one inch of the strip edge where the metallic coating is noticeably heavier than on the remainder of the strip.

Contouring the narrow dimension of the jet as described was expected to produce a heavier center coating weight to equal the heavy metal at the edges and overcome coiling difficulties. However, the surprising observation was made that such contouring essentially eliminated the occurrence of heavy metal concentrations and oxide berries at the strip edges. This is believed due to the effect illustrated in FIGS. 4 and 5.

Figure 4:
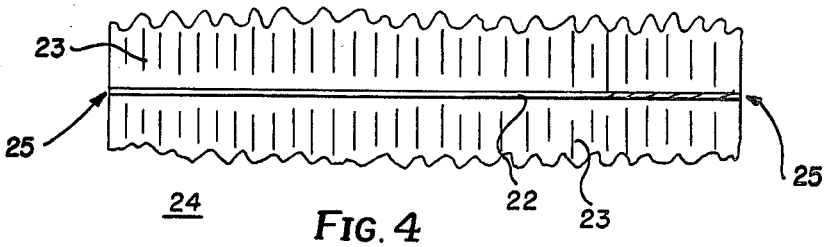
FIG. 4 is a schematic illustration looking vertically downward on the coating metal bath and the strip emerging therefrom, showing a condition which is to be avoided.

FIG. 4 is a schematic illustration looking vertically downward at the molten metal bath as the strip emerges, showing the observed condition under which oxide berries and localized heavy metal at the edges are encountered. This condition is observed when the nozzle opening and hence the narrow dimension of the jet is constant or substantially less than indicated in FIG. 3. The strip is indicated at 22. The bright bath surface (oxide free) appeared immediately adjacent each side of the strip, while the remainder of the surface of the bath 24 was covered with a heavy oxide scum. It should be observed that this heavy oxide scum extended substantially to the side edges of the strip as indicated on 25. This condition resulted in the edges of the strip having a somewhat heavier coating than the center. Furthermore, as just indicated, this practice often resulted in extremely heavy localized coating weight and oxide berries at the strip edges.

Figure 5:
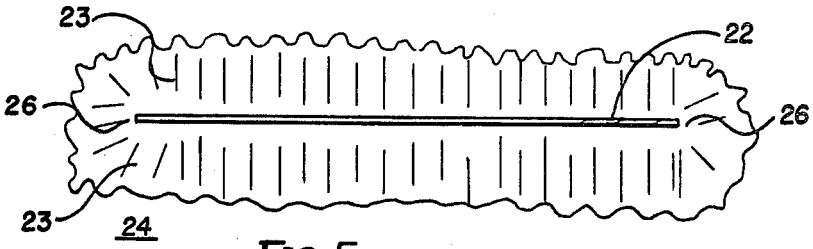
FIG. 5 is a schematic view similar to FIG. 4 showing a condition of the bath surface resulting from contouring the fluid jet according to this invention.

Contouring the nozzle opening and hence the narrow dimension of the fluid jet had the surprising result shown in FIG. 5. That is, a bright bath surface 23 is maintained outward from the strip edges as shown in 26. This maintenance of a bright bath surface outward from the strip edges substantially eliminates the problem of heavy edges and oxide berries noted above.

Why the contouring of the fluid jet should have the effect described above is not fully understood. It is believed that this condition is due in part to both the continuous flow back of excess molten coating metal from the point of impingement of the jet back to the bath and to the action of vertically downward deflection of the jet. In any event, the experimentation referred to hereinafter shows that these results are obtained only when the nozzle opening at the edge is equal to at least 150% of the nozzle opening at the center. Laboratory investigations indicate that in the case of zinc as a coating metal, a minimum return flow of approximately five ounces per minute per inch of strip width is required for satisfactory finishing. Any increase in this rate of return enhances the finishing action by more rapid return of unwanted oxides to the bath, and broadens the latitude of permissible adjustment.

Successful operation has been achieved on a commercial zinc coating line utilizing speeds from 100 to 300 feet per minute under the following conditions. The opening in a 72 inch nozzle was 0.075 inches at the center and is 0.130 inches at the edge. The increase from center to edge is substantially linear. It is believed that the opening differential required (end to center) is a function of nominal nozzle opening. That is, for narrow nozzle openings, less end to center differential opening would be required.

The preferred angle of impingement of the fluid jet on the strip (the angle is measured with reference to a plane normal to the surface of the strip) is nominally 0° and may vary from about 2° up to 5° down.

The distance between the end of the nozzle and the strip may vary between ½ inch and 2½ inches. As indicated earlier, the closer the distance between the edge of the nozzle and the strip, the lighter the finished coating weight will be other things being equal. The height above the bath at the point of impingement may vary from approximately 3 inches to on the order of 18 inches. The lower limit will be determined by that point at which excessive molten metal splatter is encountered. The upper limit will depend upon strip speed and coating weight desired.

The pressure of the jet may vary from 4 ounces per square inch to 7 pounds per square inch.

The jet may be any of various fluids, including steam, air and the like. The fluid should be heated to 600° F. or higher.

It was indicated earlier that the wiping or shearing effect of the fluid jet will vary with the distance between the nozzle and the strip. It should therefore be apparent that it is desirable to present a perfectly flat strip to the fluid jet. Maintenance of a flat strip at this point is accomplished by adjustment of the pot or sinker roll, the stabilizer roll, strip tension and the like.

It is believed that the foregoing is a full and complete disclosure of this invention.

The embodiment of the invention in which an exclusive property or privilege is claimed are defined as follows:

1. In a method of coating a flat ferrous metallic strip with a molten coating metal, wherein the still molten coating metal is finished by an elongated jet of gaseous fluid, the improvement which comprises the step of eliminating heavy edge coatings and oxide berries to produce an even coating weight from edge-to-edge across said strip, by contouring the narrow dimension of said jet to provide a relatively narrow center, said jet widening from said center to each of said strip edges, the length of said jet from said metallic strip to the source of said jet being uniform across the width of said strip.

2. The method claimed in claim 1 wherein the narrow dimension of said jet at the edge is at least 150% of the narrow dimension of said jet at the center.

3. In a method of coating a ferrous metallic strip with a molten coating metal, the improvement comprising drawing said strip through a bath of said molten coating metal, withdrawing said strip from said bath in a vertical path of travel, impinging a fluid jet on at least one surface of said strip as it rises out of said bath, impinging said fluid jet on said surface of said strip at a height above said bath where the thickness of said molten coating metal adhering to said strip is in excess of the final coating thickness, directing said fluid jet to cleanly shear said molten coating metal adhering to said strip so that the outer portion thereof flows backward down to said bath and to smooth the remainder of said molten coating metal adhering to said strip using the combination of velocity of fluid from said jet, strip speed, distance from said jet to said strip, size and contour of the narrow dimension of said jet, angle of impingement and height of the point of impingement to control the thickness of said coating metal adhering to said strip, and including the step of eliminating heavy edge coatings and oxide berries to produce an even coating weight from edge-to-edge across said strip by contouring the narrow dimension of said jet to provide a relatively narrow center, said jet widening from the center of each edge of said strip, the length of said jet from said metallic strip to the source of said jet being uniform across the width of said strip.

* * * * *